US011056129B2

(12) United States Patent
Anderson et al.

(10) Patent No.: US 11,056,129 B2
(45) Date of Patent: Jul. 6, 2021

(54) ADAPTIVE PARAMETRICALLY FORMULATED NOISE SYSTEMS, DEVICES, AND METHODS

(71) Applicants: Dean Robert Gary Anderson, Orem, UT (US); Dean Gregory Anderson, Vernal, UT (US)

(72) Inventors: Dean Robert Gary Anderson, Orem, UT (US); Dean Gregory Anderson, Vernal, UT (US)

( * ) Notice: Subject to any disclaimer, the term of this patent is extended or adjusted under 35 U.S.C. 154(b) by 0 days.

(21) Appl. No.: 15/947,763

(22) Filed: Apr. 6, 2018

(65) Prior Publication Data

US 2018/0301159 A1 Oct. 18, 2018

Related U.S. Application Data

(60) Provisional application No. 62/482,675, filed on Apr. 6, 2017.

(51) Int. Cl.

| | |
|---|---|
| ***G10L 21/0232*** | (2013.01) |
| ***G10L 21/0264*** | (2013.01) |
| ***G10L 21/0208*** | (2013.01) |
| ***G10L 25/48*** | (2013.01) |
| ***H04R 25/00*** | (2006.01) |
| *G10L 25/78* | (2013.01) |
| *G10L 25/21* | (2013.01) |

(52) U.S. Cl.

CPC ..... *G10L 21/0232* (2013.01); *G10L 21/0208* (2013.01); *G10L 21/0264* (2013.01); *G10L 25/48* (2013.01); *H04R 25/356* (2013.01); *H04R 25/50* (2013.01); *G10L 25/21* (2013.01); *G10L 25/78* (2013.01); *G10L 2021/02087* (2013.01)

(58) Field of Classification Search

CPC .. G10L 21/0232; G10L 21/0264; G10L 25/78
USPC ..... 704/226, 233
See application file for complete search history.

(56) References Cited

U.S. PATENT DOCUMENTS

| | | | | |
|---|---|---|---|---|
| 8,175,871 | B2 * | 5/2012 | Wang | H04M 9/082 704/227 |
| 2005/0114128 | A1 * | 5/2005 | Hetherington | G10L 21/0208 704/233 |
| 2005/0187763 | A1 * | 8/2005 | Arun | G10L 21/0208 704/226 |
| 2006/0074651 | A1 * | 4/2006 | Arun | G10L 15/22 704/233 |
| 2007/0150270 | A1 * | 6/2007 | Huang | G10L 21/0208 704/226 |
| 2011/0064253 | A1 * | 3/2011 | Gran | H04R 25/453 381/312 |

(Continued)

*Primary Examiner* — Jakieda R Jackson
(74) *Attorney, Agent, or Firm* — Daniel Anderson

(57) ABSTRACT

In one embodiment, an audio system can generate a parametrically formulated noise signal which can be adaptively reconfigured according to an input signal. According to an embodiment, an audio system can adaptively adjust a parametrically formulated noise signal according to environmental noise detected by the audio system. According to an embodiment, an audio system can present an adaptive level of activation energy in the presence of environmental noise such that a substantially constant and sufficient level of activation energy can be presented to an individual's auditory system such that additional sound energy corresponding to speech can become audible and intelligible to the individual.

19 Claims, 7 Drawing Sheets

(56) References Cited

U.S. PATENT DOCUMENTS

2017/0230765 A1* 8/2017 Jensen ..... H04R 25/554
2018/0197558 A1* 7/2018 Schroeter ..... G10L 21/0216

* cited by examiner

ADAPTIVE PARAMETRICALLY FORMULATED NOISE SYSTEMS, DEVICES, AND METHODS

CROSS-REFERENCE TO RELATED APPLICATIONS

This application claims priority to U.S. Provisional Application No. 62/482,675 filed Apr. 6, 2017, the content of which is hereby incorporated by reference.

BACKGROUND

The present invention relates, in general, to electronics and, more particularly, to audio systems, devices, and methods.

The duration of a speech phoneme is typically more than forty milliseconds and generally less than a second. There are many sounds which are uncharacteristic of speech, for example, sounds of significant duration such as tire noise while driving along a highway or sounds of extremely short duration such as a fork hitting a plate. These sounds may be thought of as "problematic noise" when they interfere with an individual's ability to hear and understand, or when they lead to distraction.

There are two main types of hearing loss, conductive hearing loss and sensorineural hearing loss. Conductive hearing loss can occur when sound is not conducted efficiently through the outer ear canal to the eardrum and the tiny bones (ossicles) of the middle ear. Sensorineural hearing loss can occur when there is damage to the inner ear, cochlea, or hearing nerve. Conventional hearing aids have employed sound amplification to mitigate the effects for both types of hearing loss. In fact, United States regulations define a hearing aid as a "wearable sound-amplifying device that is intended to compensate for impaired hearing" (21 CFR 874.3300).

Conventional hearing aid devices use dynamic range compression to ensure that the resulting amplified sound signal is above the threshold of hearing and below an uncomfortably loud level. Dynamic range compression reduces sound signal contrast and compresses noise and speech together. Signal-to-noise compression reduces speech intelligibility, particularly in noisy environments or environments where noise is present. Conventional hearing aids typically employ complex and expensive noise reduction circuitry and programming in order to mitigate the effects of signal-to-noise compression.

Accordingly, it is desirable to have an audio system, device, and method for solving at least the above mentioned problems. It is desirable to have an audio system, device, and method which reduces the amount of compression used, does not use compression within certain frequency ranges, or uses no compression. Furthermore, it is desirable to have an audio system, device, and method which is effective in improving speech intelligibility in problematic noise environments. It is also desirable to have an audio system, device, and method which can control loudness growth to ensure that soft speech is audible and loud speech remains comfortable, and which does not use dynamic range compression, does not use dynamic range compression within certain frequency ranges, or reduces the amount of dynamic range compression used.

Figure 1:
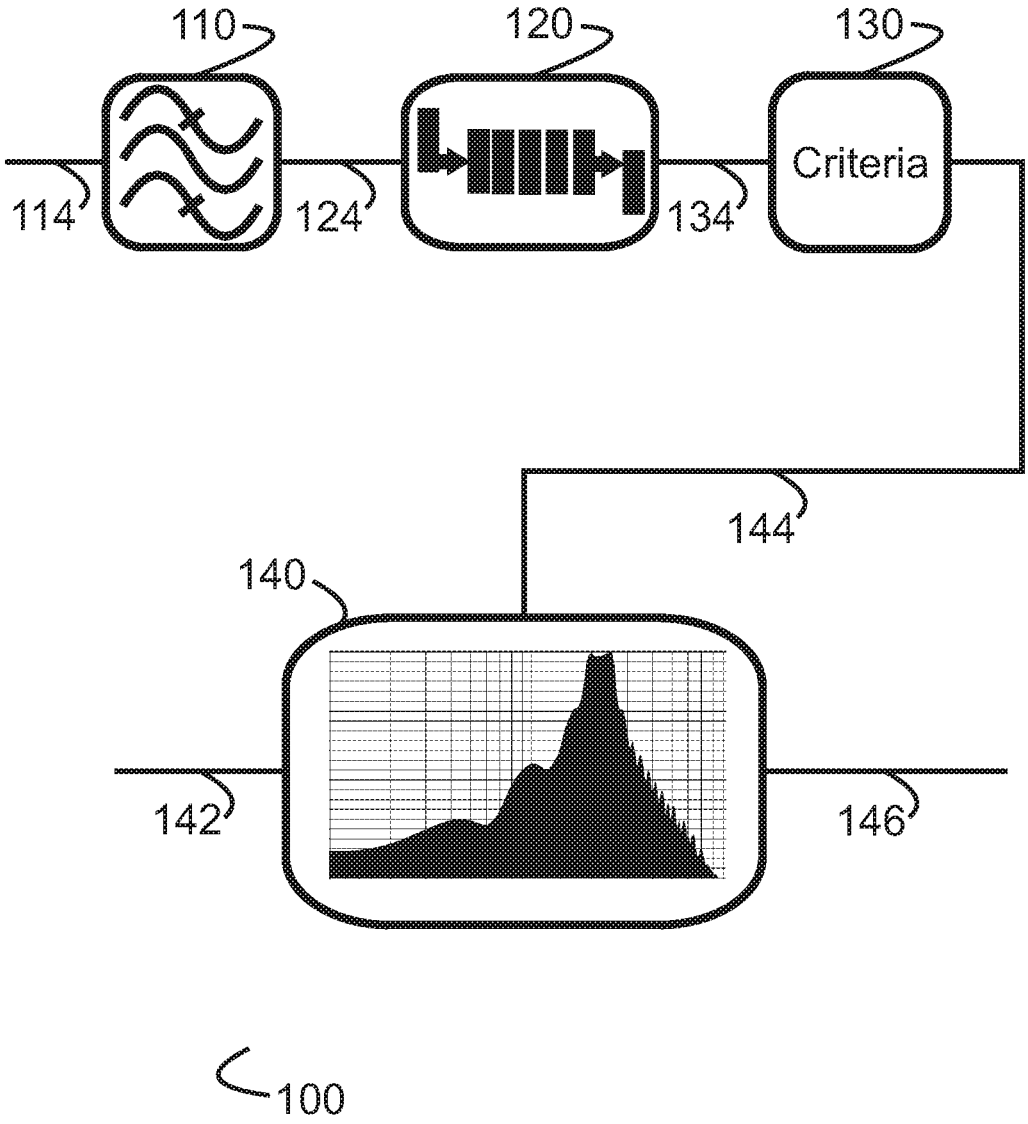
FIG. 1 illustrates a schematic diagram of an audio system.

The drawings and detailed description are provided in order to enable a person skilled in the applicable arts to make and use the invention. The systems, structures, circuits, devices, elements, schematics, signals, signal processing schemes, flow charts, diagrams, algorithms, frequency values and ranges, amplitude values and ranges, methods, source code, examples, etc., and the written descriptions are illustrative and not intended to be limiting of the disclosure. Descriptions and details of well-known steps and elements are omitted for simplicity of the description.

For simplicity and clarity of the illustration, elements in the figures are not necessarily drawn to scale, and the same reference numbers in different figures denote the same elements.

As used herein, the term and/or includes any and all combinations of one or more of the associated listed items. In addition, the terminology used herein is for the purpose of describing particular embodiments only and is not intended to be limiting of the disclosure. As used herein, the singular forms are intended to include the plural forms as well, unless the context clearly indicates otherwise. It will be further understood that the terms comprise, comprises, comprising, include, includes, and/or including, when used in this specification and claims, are intended to specify a non-exclusive inclusion of stated features, numbers, steps, acts, operations, values, elements, and/or components, but do not preclude the presence or addition of one or more other features, numbers, steps, acts, operations, values, elements, components, and/or groups thereof. It will be understood that, although the terms first, second, etc. may be used herein to describe various signals, portions of signals, ranges, members, and/or elements, these signals, portions of signals, ranges, members, and/or elements should not be limited by these terms. These terms are only used to distinguish one signal, portion of a signal, range, member, and/or element from another. Thus, for example, a first signal, a first portion of a signal, a first range, a first member, and/or a first element discussed below could be termed a second signal, a second portion of a signal, a second range, a second member, and/or a second element without departing from the teachings of the present disclosure. It will be appreciated by those skilled in the art that words, during, while, concurrently, and when as used herein related to audio systems, devices, methods, signal processing and so forth, are not limited to a meaning that an action, step, function, or process must take place instantly upon an initiating action, step, process, or function, but can be understood to include some small but reasonable delay, such as propagation delay, between the reaction that is initiated by the initial action, step, process, or function. Additionally, the terms during, while, concurrently, and when are not limited to a meaning that an action, step, function, or process only occur during the duration of another action, step, function, or process, but can be understood to mean a certain action, step, function, or process occurs at least within some portion of a duration of another action, step, function, or process or at least within some portion of a duration of an initiating action, step, function, or process or within a small but reasonable delay after an initiating action, step, function, or process. Furthermore, as used herein, the term range, may be used to describe a set of frequencies having an approximate upper and approximate lower bound, however, the term range may also indicate a set of frequencies having an approximate lower bound and no defined upper bound, or an upper bound which is defined by some other characteristic of the system. The term range may also indicate a set of frequencies having an approximate upper bound and no defined lower bound, or a lower bound which is defined by some other characteristic of the system. Reference to "one embodiment" or "an embodiment" means that a particular feature, structure, or characteristic described in connection with the embodiment is included in at least one embodiment of the present disclosure. Thus, appearances of the phrases "in one embodiment" or "in an embodiment" in various places throughout this specification are not necessarily all referring to the same embodiment, but in some cases it may. The use of words about, approximately or substantially means a value of an element is expected to be close to a stated value or position. However, as is well known in the art there are always minor variances preventing values or positions from being exactly stated. It is further understood that the embodiments illustrated and described hereinafter suitably may have embodiments and/or may be practiced in the absence of any element that is not specifically disclosed herein. Furthermore, it is understood that in some cases the embodiments illustrated and described hereinafter suitably may have embodiments and/or may be practiced with one or more of the illustrated or described elements, blocks, or signal processing steps omitted.

It is noted that while the invention described herein is described in context of audio systems, devices, and methods, the invention will also find application in many mechanical, electrical, power, and communications systems, devices, and methods.

Those skilled in the art will understand that as used herein, the terms add, added, adding, mix, mixed, or mixing may refer to any type of combination or summation of elements, signals, portions of signals, amplitudes, numbers, values, variables, sets, arrays, or objects. For example, the use of the terms add, added, adding, mix, mixed, or mixing may indicate electronic addition or mixing, numerical addition or mixing, digital addition or mixing, analog addition or mixing, or mechanical addition or mixing, such as air conduction mixing of acoustic signals.

Those skilled in the art will understand that as used herein, the terms audio device or audio system can refer to a stand-alone system or a subsystem of a larger system. A non-limiting list of example audio systems can include: hearing aids, personal sound amplification products, televisions, radios, cell phones, telephones, computers, laptops, tablets, vehicle infotainment systems, audio processing equipment and devices, personal media players, portable media players, audio transmission systems, transmitters, receivers, public address systems, media delivery systems, internet media players, smart devices, hearables, recording devices, subsystems within any of the above devices or systems, or any other device or system which processes audio signals.

As herein described or illustrated, components, elements, or blocks that are connected, coupled, or in communication may be electronically coupled so as to be capable of sending and/or receiving electronic signals between electronically coupled components, elements, or blocks, or linked so as to be capable of sending and/or receiving digital or analog signals, or information, between linked components, elements, or blocks. Coupling or connecting components, elements, or blocks as described or illustrated herein does not foreclose the possibility of including other intervening components, elements or blocks between the coupled or connected components, elements, or blocks. Coupling or connecting may be accomplished by hard wiring components elements or blocks, wireless communication between components, elements, or blocks, on-chip or on-board communications and the like.

Many electronic and mechanical alternatives are also possible to implement individual objectives of various components, elements, or blocks described or illustrated herein. For example, the function of a mixer could be accomplished via air conduction mixing of two acoustic signals. Furthermore, software or firmware operating on a digital device may be used to implement individual objectives of various components, elements, instrumentalities, or blocks described or illustrated herein.

Multiple instances of embodiments described or illustrated herein may be used within a single audio device or system. As an example, multiple instances of embodiments described or illustrated herein may enable the processing of subdivisions of the various ranges of frequencies described herein. As another example, multiple instances of embodiments described or illustrated herein may enable a stereo audio device comprising a first instance of an embodiment for a right band and a second instance of an embodiment for a left band.

The inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material, or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials, or acts that perform the claimed function as described in alternative embodiments or forms of the invention, or that are well known present or later-developed, equivalent structures, material, or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software, hardware or a combination of both. It should be noted that there are many different and alternative configurations, devices, and technologies to which the disclosed inventions may be applied. Thus, the full scope of the invention is not limited to the examples that are described below.

Various aspects of the present invention may be described in terms of functional block components and various signal processing steps. Such functional blocks may be realized by any number of hardware and/or software components configured to perform the specified functions and achieve the various results. In addition, various aspects of the present invention may be practiced in conjunction with any number of audio devices, and the systems and methods described are merely exemplary applications for the invention. Further, exemplary embodiments of the present invention may employ any number of conventional techniques for audio filtering, amplification, noise generation, modulation, mixing, and the like.

It is noted that signal processing can be done in analog or digital form and various systems have a mixture of both analog and digital processes. The invention described herein can be implemented by analog or digital processes or a mixture of both analog and digital processes. Thus it is not a limitation of the invention that any particular process be implemented as either analog or digital. Those skilled in the art will readily see how to implement the invention using both analog and digital processes to achieve the results and benefits of the invention.

Various representative implementations of the present invention may be applied to any system for audio devices. For example, certain representative implementations may include: hearing aid devices and personal sound amplification products.

DETAILED DESCRIPTION OF THE DRAWINGS

FIG. 1 illustrates a schematic diagram of an audio system 100 comprising adaptive parametrically formulated noise. According to various embodiments, audio system 100 produces a parametrically formulated noise signal 146 wherein the parametrically formulated noise signal 146 adaptively reconfigures in response to an audio signal 114.

According to an embodiment, audio system 100 can comprise an audio signal meter 110 configured to receive an audio signal 114 and measure the audio signal energy substantially within a frequency band during a time interval of audio signal 114. Audio signal meter 110 can also be configured to generate audio signal measurement values 124. Audio system 100 can also comprise a storage device 120 coupled to audio signal meter 110 and storage device 120 can be configured to receive and store a plurality of audio signal energy measurements or audio signal energy measurement values 124 for sequential time intervals from audio signal meter 110. Audio system 100 can also comprise an audio signal energy detector 130 configured to identify within a plurality of audio signal energy measurement values 124 a particular characteristic or criteria. For example, audio signal energy detector could be configured to detect a minimum value from among the audio signal energy measurement values 124 and generate characteristic or criteria measurement values 144. As another example, audio signal energy detector 124 can be configured to detect characteristics indicative of voice activity in an audio signal and generate criteria measurement values 144 to indicate that speech activity or voice activity is occurring. Audio system 100 can also comprise a parametrically formulated noise generator 140, wherein the parametrically formulated noise generator can be configured receive criteria measurement values 144 from audio signal energy detector 130 and adaptively reconfigure an output of parametrically formulated noise generator 140 in response to criteria measurement values 144. For example, a criteria measurement value 144 may indicate that speech or voice activity is ongoing in an audio signal and parametrically formulated noise generator 140 can reconfigure a parametrically formulated noise signal to supplement the speech sounds and increase the intelligibility of the speech sounds to a user of audio system 140.

According to an embodiment, audio signal meter 110 can measure an audio signal's energy substantially within a ⅓-octave frequency band during about a forty millisecond time interval. Various types of audio signal meters can be used to measure the energy of audio signal 114. For example, various types of analog circuits, digital circuits, computer software, and/or digital signal processors can be used to measure and analyze audio signals, including audio signal 114. These audio signal meters can measure energy within an audio signal by measuring various attributes or characteristics of an audio signal. For example, an audio signal meter 110 can be used to take voltage measurements, current measurements, power measurements, numerical values measurements, pulse density measurements, pulse period measurements, time integration measurements, and/or counter measurements. Furthermore, according to various embodiments, various frequency ranges and time intervals can be selected or implemented by audio signal meter 110 to measure audio signal energy.

According to an embodiment, storage device 120 can store a plurality of audio signal energy measurements 124 for sequential time intervals in various manners including, a first in, first out (FIFO) data buffer which can organize and manipulate, for example, fifty immediately previous sequential audio signal energy measurements. Various types of storage device 120 can be used, including those associated with digital signal processing, hardware shift registers, memory structures, circular buffers, and the like. Storage device 120 can comprise, for example, any type of data storage device, including, for example, memory, volatile memory, non-volatile memory, RAM, flash, DRAM, SRAM, magnetic, EEPROM, etc. Additionally, various storage sizes can be used.

According to an embodiment, audio signal energy detector 130 can detect from array of audio signal energy measurement values 134 minimum measurement values and generate criteria measurement values 144 corresponding to minimum measurement values. According to an embodiment, audio signal energy detector 130 can be configured to detect a minimum value by iterating through a FIFO data buffer using a minimum selection computer algorithm. Various algorithms for detecting minimum measurement values can be used, including: recursive algorithms, sorting algorithms, rolling difference algorithms and the like.

According to an embodiment, parametrically formulated noise generator 140 generate a parametrically formulated noise signal 146. According to an embodiment, parametrically formulated noise generator can be configured to receive criteria measurement values 144 and respond by generating a parametrically formulated noise signal 146 with a power spectrum output that is reduced or increased proportionally to the criteria audio signal energy measurement values 144. According to an embodiment, parametrically formulated noise generator 140 can be configured to respond with a power spectrum output that is reduced or increased proportionally to the criteria measurement values 144 wherein the transition time change of the criteria measurement values 144 can be controlled with attack and decay time constants. Various methods can be implemented to adaptively reconfigure parametrically formulated noise generator 140 in response to criteria measurement values 144 generated by audio signal energy detector.

Parametrically formulated noise generator 140 can be configured to receive a plurality of parameters 142 for configuring parametrically formulated noise generator 140. According to an embodiment, plurality of parameters 142 can be parameters representing a ratio of duration of a plurality of periodic waves. Parametrically formulated noise generator can generate a parametrically formulated noise signal 146 by time ordering, in a random or pseudorandom order, a plurality of periodic waves having frequencies within a first range of frequencies. According to an embodiment, a plurality of parameters 142 representing a ratio of duration for each of the plurality of periodic waves can be used by parametrically formulated noise generator 140 to control or contour the power spectrum amplitude of parametrically formulated noise signal 146 across the first range of frequencies. Control of the power spectrum amplitude across the first range of frequencies can be accomplished by weighting the occurrence or ratio of duration of each of the plurality of periodic waves according to the plurality of parameters 142 which, according to an embodiment, can represent a ratio of duration for each of the plurality of periodic waves. According to an embodiment, parametrically formulated noise generator 140 can be further configured to configure or adaptively reconfigure parametrically formulated noise signal 146 in response to criteria measurement values 144. For example, in response to a minimum criteria measurement value 144, parametrically formulated noise generator 140 may reduce proportionally the overall volume, power spectrum output, or amplitude of parametrically formulated noise signal 146.

According to various embodiments, an audio system may incorporate a plurality of instances of audio system 100 spanning a plurality of frequency bands. According to an embodiment, an audio system may incorporate twelve instances of audio system 100 spanning twelve ⅓-octave frequency bands: from 396 Hertz (Hz) to 500 Hz; from 500 Hz to 630 Hz; from 630 Hz to 794 Hz; from 794 Hz to 1000 Hz; from 1000 Hz to 1260 Hz; from 1260 Hz to 1587 Hz; from 1588 Hz to 2000 Hz; from 2000 Hz to 2520 Hz; from 2520 Hz to 3175 Hz; from 3175 Hz to 4000 Hz; from 4000 Hz to 5040 Hz; and, from 5040 Hz to 6350 Hz.

According to various embodiments, audio system 100 can be configured to produce a parametrically formulated noise signal 146 wherein the parametrically formulated noise signal 146 can be adaptively reconfigured in response to audio signal 114 and in particular to measured values of audio signal 114. According to an embodiment, audio signal energy detector 130 can be configured to detect the occurrence of a maximum audio signal energy. Alternatively, audio signal energy detector 130 can be configured to detect a minimum audio signal energy. In another embodiment, audio signal energy detector 130 can be configured to detect and calculate an average audio signal energy. In yet various other embodiments, audio signal energy detector 130 can be configured to detect other criteria, such as a transient audio signal energy, a peak audio signal energy, or a combination of any of the above described criteria and the like. In another embodiment, audio signal energy detector can be configured to detect the presence of voice activity or speech sounds. Sound or audio signals carrying voice activity and/or speech sounds have features and characteristics which indicate the presence of voice activity and/or speech sounds. For example, the cadence and frequency of certain amplitude changes in a sound signal can indicate the presence of voice activity. In response to, audio signal energy detector 130 can generate criteria measurement values 144 and provide such values to parametrically formulated noise generator 140, which in turn can generate or modify a parametrically formulated noise signal corresponding to the criteria measurement values 144 accordingly.

Figure 2:
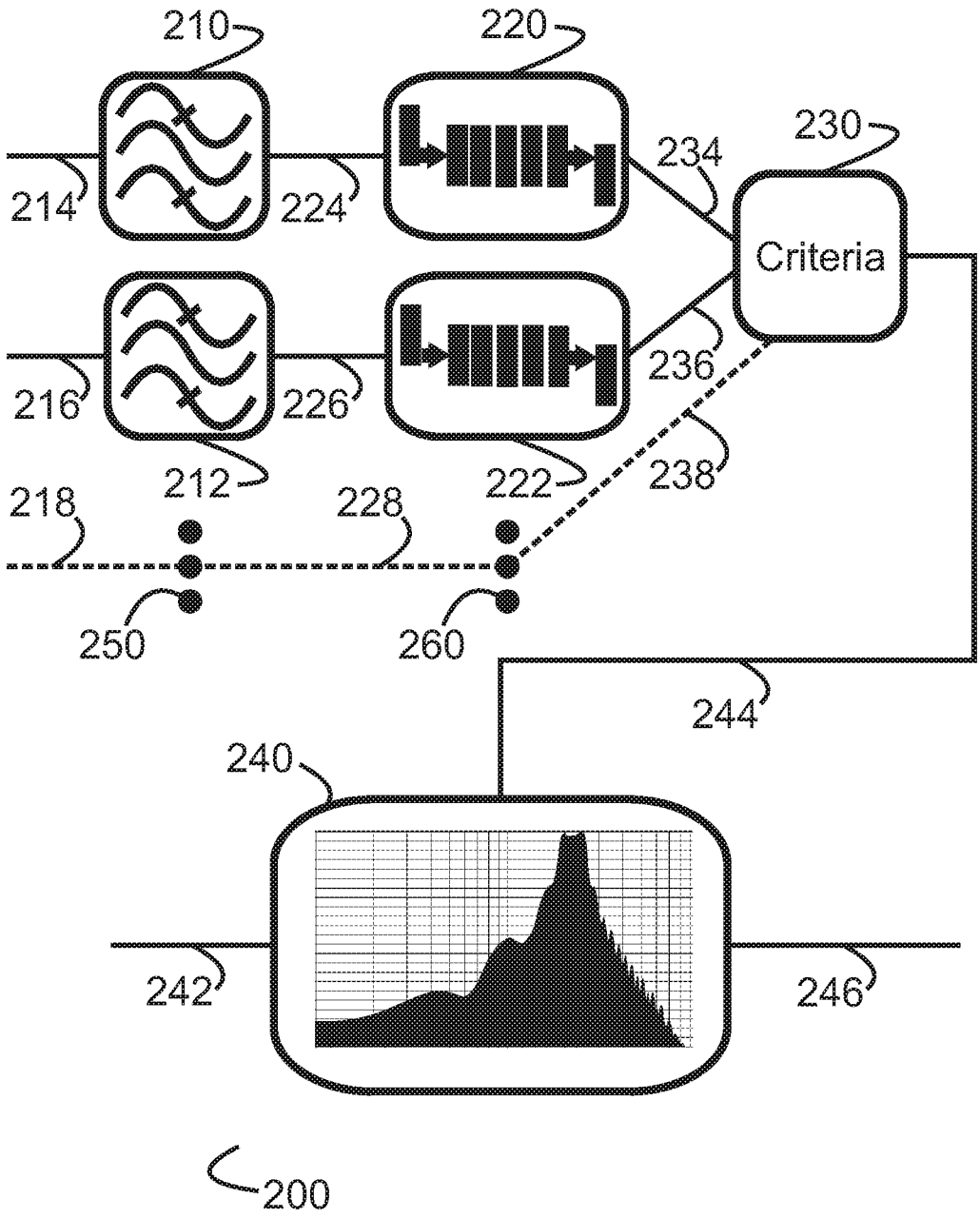
FIG. 2 illustrates a schematic diagram of an audio system.

FIG. 2 illustrates a schematic diagram of an audio system 200 comprising adaptive parametrically formulated noise. According to an embodiment, audio system 200 can be configured to produce a parametrically formulated noise signal 246 wherein the parametrically formulated noise signal 246 can be adaptively reconfigured in response to a first audio signal 214 and a second audio signal 216.

According to an embodiment, audio system 200 can be configured comprising a first audio signal meter 210 and a second audio signal meter 212, each configured to measure audio signal energy from first and second audio signals 214 and 216 respectively during a time interval and generate first and second audio signal measurement values 224 and 226 respectively. According to an embodiment audio signal 214 can comprise an audio signal substantially within a first frequency band and audio signal 216 can comprise an audio signal substantially within a second frequency band. First audio signal measurement values 214 can be provided to a first storage device 220 and second audio signal measurement values 222 can be provided to a second storage device 222. First and second storage devices 220 and 222 can be configured to store a first and second plurality or array of audio signal energy measurement values 234 and 236, respectively, for sequential time intervals and provide first and second audio signal energy measurement values 234 and 236 to an audio signal energy detector 230. Audio signal detector 230 can be configured to identify within first and/or second arrays of audio signal energy measurement values 234 and 236 a particular characteristic or criteria. For example, audio signal energy detector 230 could be configured to detect a minimum value from among the array of audio signal energy measurement values 234 and/or 236 and generate characteristic or criteria measurement values 244.

Parametrically formulated noise generator 240 can be configured to receive a plurality of parameters 242 for configuring parametrically formulated noise generator 240. According to an embodiment, plurality of parameters 242 can be parameters representing a ratio of duration of a plurality of periodic waves. Parametrically formulated noise generator can generate a parametrically formulated noise signal 246 by time ordering, in a random or pseudorandom order, a plurality of periodic waves having frequencies within a first range of frequencies. According to an embodiment, a plurality of parameters 242 representing a ratio of duration for each of the plurality of periodic waves can be used by parametrically formulated noise generator 240 to control or contour the power spectrum amplitude of parametrically formulated noise signal 246 across the first range of frequencies. Control of the power spectrum amplitude across the first range of frequencies can be accomplished by weighting the occurrence or ratio of duration of each of the plurality of periodic waves according to the plurality of parameters 242 which, according to an embodiment, can represent a ratio of duration for each of the plurality of periodic waves. According to an embodiment, parametrically formulated noise generator 240 can be further configured to configure or adaptively reconfigure parametrically formulated noise signal 246 in response to criteria measurement values 244. For example, in response to a minimum criteria measurement value 244, parametrically formulated noise generator 240 may reduce proportionally the overall volume, power spectrum output, or amplitude of parametrically formulated noise signal 246.

According to an embodiment, first audio signal meter 210 can be configured to measure audio signal energy substantially within a ⅙-octave frequency band during about a forty millisecond time interval. According to an embodiment, second audio signal meter 212 can be configured to measure audio signal energy substantially within an adjacent ⅙-octave frequency band during about a forty millisecond time interval. Various types of audio signal meters can be used to measure the energy of first audio signal 214 and/or second audio signal 216. For example, various types of analog circuits, digital circuits, computer software, and/or digital signal processors can be used to measure and analyze audio signals. These audio signal meters can measure energy within an audio signal by measuring various attributes or characteristics of an audio signal. For example, a first audio signal meter 210 can be used to take voltage measurements, current measurements, power measurements, numerical values measurements, pulse density measurements, pulse period measurements, time integration measurements, and/or counter measurements. Furthermore, according to various embodiments, various frequency ranges and time intervals can be selected or implemented by a first audio signal meter 210 to measure audio signal energy.

According to an embodiment, first and second storage devices 220 and 222 can store a plurality of first and second audio signal energy measurements 224 and 226 respectively for sequential time intervals in various manners including, a first in, first out (FIFO) data buffer which can organize and manipulate, for example, fifty immediately previous sequential audio signal energy measurements. Various types of storage devices can be used, including those associated with digital signal processing, hardware shift registers, memory structures, circular buffers, and the like. Storage devices 220 and 222 can comprise, for example, any type of data storage device, including, for example, memory, volatile memory, non-volatile memory, RAM, flash, DRAM, SRAM, magnetic, EEPROM, etc. Additionally, various storage sizes can be used.

According to an embodiment, audio signal energy detector 230 can detect from first and second arrays of audio signal energy measurement values 234 and 236 minimum measurement values and generate criteria measurement values 244 corresponding to the minimum measurement values. According to an embodiment, audio signal energy detector 130 can be configured to detect a minimum value by iterating through a FIFO data buffer using a minimum selection computer algorithm. Various algorithms for detecting minimum measurement values can be used, including: recursive algorithms, sorting algorithms, rolling difference algorithms, and the like.

According to an embodiment, parametrically formulated noise generator 240 can generate a parametrically formulated noise signal 246. According to an embodiment, parametrically formulated noise generator can be configured to receive criteria measurement values 244 and respond by generating a parametrically formulated noise signal 246 with a power spectrum output that is reduced or increased proportionally to the criteria audio signal energy measurement values 244. According to an embodiment, parametrically formulated noise generator 240 can be configured to respond with a power spectrum output that is reduced or increased proportionally to the criteria measurement values 244 wherein the transition time change of the criteria measurement values 244 can be controlled with attack and decay time constants. Various methods can be implemented to adaptively reconfigure parametrically formulated noise generator 240 in response to criteria measurement values 244 generated by audio signal energy detector.

Parametrically formulated noise generator 240 can be configured to receive a plurality of parameters 242 for configuring parametrically formulated noise generator 240. According to an embodiment, plurality of parameters 242 can be parameters representing a ratio of duration of a plurality of periodic waves. Parametrically formulated noise generator can generate a parametrically formulated noise signal 246 by time ordering, in a random or pseudorandom order, a plurality of periodic waves having frequencies within a first range of frequencies. According to an embodiment, a plurality of parameters 242 representing a ratio of duration for each of the plurality of periodic waves can be used by parametrically formulated noise generator 240 to control or contour the power spectrum amplitude of parametrically formulated noise signal 246 across the first range of frequencies. Control of the power spectrum amplitude across the first range of frequencies can be accomplished by weighting the occurrence or ratio of duration of each of the plurality of periodic waves according to the plurality of parameters 242 which, according to an embodiment, can represent a ratio of duration for each of the plurality of periodic waves. According to an embodiment, parametrically formulated noise generator 240 can be further configured to configure or adaptively reconfigure parametrically formulated noise signal 246 in response to criteria measurement values 244. For example, in response to a minimum criteria measurement value 244, parametrically formulated noise generator 240 may reduce proportionally the overall volume, power spectrum output, or amplitude of parametrically formulated noise signal 246.

According to various embodiments, an audio system may incorporate a plurality of instances of audio system 200 spanning a plurality of frequency bands. According to an embodiment, an audio system may incorporate twelve instances of audio system 200, each spanning a pair of adjacent ⅙-octave frequency bands, whereupon each pair of frequency bands spans ⅓-octave intervals: from 396 Hz to 500 Hz; from 500 Hz to 630 Hz; from 630 Hz to 794 Hz; from 794 Hz to 1000 Hz; from 1000 Hz to 1260 Hz; from 1260 Hz to 1587 Hz; from 1588 Hz to 2000 Hz; from 2000 Hz to 2520 Hz; from 2520 Hz to 3175 Hz; from 3175 Hz to 4000 Hz; from 4000 Hz to 5040 Hz; and, from 5040 Hz to 6350 Hz.

Audio system 200 can be configured to incorporate additional audio signal meters 250 and storage devices 260 each with corresponding elements 218, 228, and 238 similar to 214, 224, and 234 as described above. According to an embodiment, three audio signal meters to measure audio signal energy and three storage devices to store a plurality of audio signal energy measurements can be used. Accordingly each of the three instances can be used to measure audio signal energy, store associated values, and find minimum values in adjacent ⅙-octave frequency bands. According to another embodiment, four audio signal meters can be implemented to measure audio signal energy and four storage devices can be used to store a multiplicity of audio signal energy measurements. Accordingly, each of the four instances can measure audio signal energy, store associated measurements, and find minimum values in adjacent 1/12-octave frequency bands.

According to various embodiments, audio system 200 can be configured to produce a parametrically formulated noise signal 246 wherein the parametrically formulated noise signal 246 can be adaptively reconfigured in response to audio signals 214 and 216 and in particular to measured values of audio signals 214 and 216. According to an embodiment, audio signal energy detector 230 can be configured to detect voice activity or speech sounds. According to an embodiment, audio signal energy detector 230 can be configured to detect the occurrence of a maximum audio signal energy. Alternatively, audio signal energy detector 230 can be configured to detect a minimum audio signal energy. In another embodiment, audio signal energy detector 230 can be configured to detect and calculate an average audio signal energy. In yet various other embodiments, audio signal energy detector 230 can be configured to detect other criteria, such as a transient audio signal energy, a peak audio signal energy, or a combination of any of the above described criteria and the like. In response, audio signal energy detector 230 can generate criteria measurement values 244 and provide such values to parametrically formulated noise generator 240, which in turn can generate or modify a parametrically formulated noise signal to corresponding to the criteria measurement values 244 accordingly.

According to an embodiment, audio signal 214, audio signal 216, and audio signal 218 can be identical signals. According to an embodiment, audio signal 214, audio signal 216, and audio signal 218 can be different signals. According to an embodiment, audio signal 214, audio signal 216, and audio signal 218 can be different filtered frequency bands of the same signal.

Figure 3:
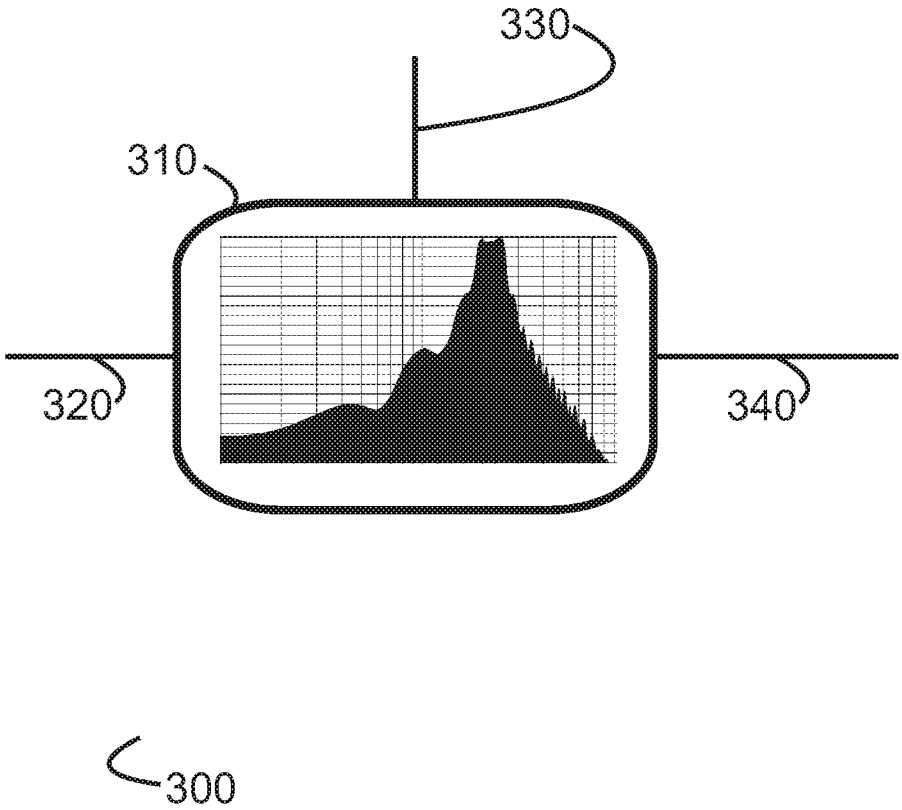
FIG. 3 illustrates a schematic diagram of an audio system.

FIG. 3 illustrates a schematic diagram of an audio system 300 comprising adaptive parametrically formulated noise. According to an embodiment, audio system 300 can produce a parametrically formulated noise signal 340 wherein the parametrically formulated noise signal 340 can be adaptively reconfigured in response to an audio signal or audio signal information 330.

According to an embodiment, audio system 300 comprises: a parametrically formulated noise generator 310, wherein the parametrically formulated noise generator is configured to adaptively reconfigure in response to audio signal information 330.

According to an embodiment, parametrically formulated noise generator 310 can be configured to receive a plurality of parameters 320 for configuring and generating parametrically formulated noise signal 340. According to an embodiment, parametrically formulated noise generator 310 can also be configured to receive audio signal information 330. According to an embodiment, parametrically formulated noise generator 310 can be configured to produce parametrically formulated noise signal 340 wherein parametrically formulated noise signal 340 is continuously adaptively reconfigured in response to audio signal information 330.

According to various embodiments, an audio system may incorporate a plurality of instances of audio system 300 spanning a plurality of frequency bands. According to an embodiment, an audio system may incorporate twelve instances of audio system 300 spanning twelve ⅓-octave frequency bands: from 396 Hz to 500 Hz; from 500 Hz to 630 Hz; from 630 Hz to 794 Hz; from 794 Hz to 1000 Hz; from 1000 Hz to 1260 Hz; from 1260 Hz to 1587 Hz; from 1588 Hz to 2000 Hz; from 2000 Hz to 2520 Hz; from 2520 Hz to 3175 Hz; from 3175 Hz to 4000 Hz; from 4000 Hz to 5040 Hz; and, from 5040 Hz to 6350 Hz.

According to various embodiments, parametrically formulated noise generator 310 can be adaptively reconfigured in response to audio signal information 330, including, but are not limited to: response to minimum audio signal energy measurements, response to maximum audio signal energy measurements, response to average audio signal energy measurements, response to transient audio signal energy measurements, response to peak audio signal energy measurements, response to a combination of audio signal energy measurements representing a combination of criteria, etc.

Figure 4:
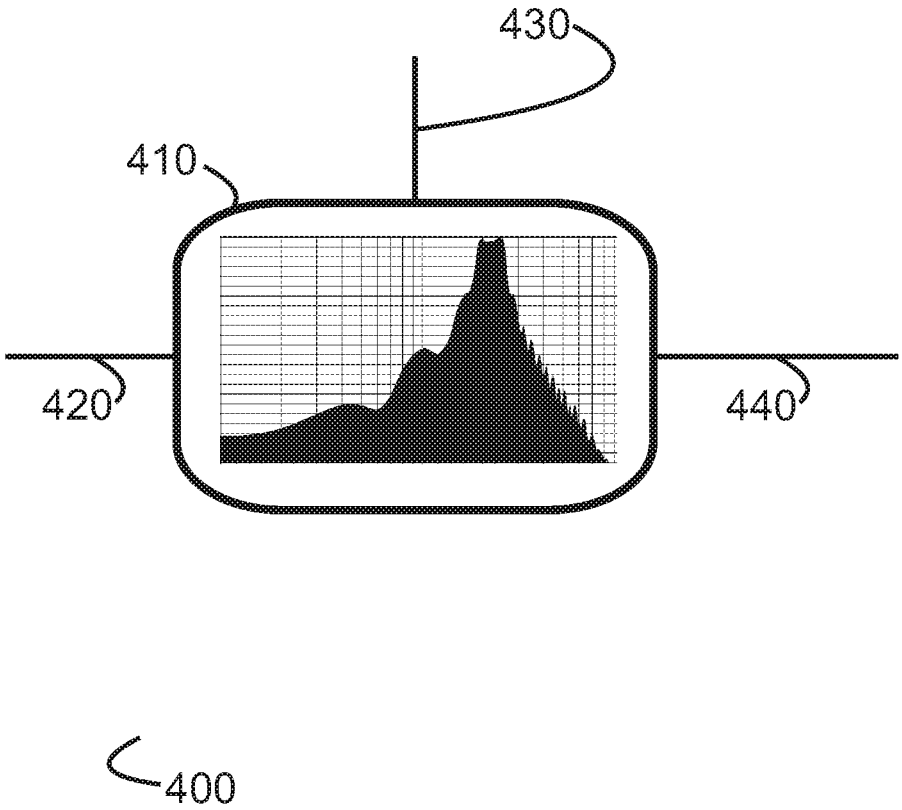
FIG. 4 illustrates a schematic diagram of a system.

FIG. 4 illustrates a schematic diagram of a system 400 comprising adaptive parametrically formulated noise. According to an embodiment, system 400 can be configured to produce a parametrically formulated noise signal 440 wherein the parametrically formulated noise signal 440 is adaptively reconfigured in response to signal information 430.

According to an embodiment, system 400 can comprise a parametrically formulated noise generator 410, wherein the parametrically formulated noise generator is configured to adaptively reconfigure in response to signal information 430.

According to an embodiment, parametrically formulated noise generator 410 can be configured to receive a plurality of parameters 420 for configuring and generating parametrically formulated noise signal 440. According to an embodiment, parametrically formulated noise generator 410 can be configured to receive signal information 430. According to an embodiment, parametrically formulated noise generator 410 can be configured to produce a parametrically formulated noise signal 440 wherein the parametrically formulated noise signal 440 can be adaptively reconfigured in response to signal information 430.

According to various embodiments, an audio system may incorporate a plurality of instances of audio system 400 spanning a plurality of frequency bands. According to an embodiment, an audio system may incorporate twelve instances of system 400 spanning twelve ⅓-octave frequency bands: from 396 Hz to 500 Hz; from 500 Hz to 630 Hz; from 630 Hz to 794 Hz; from 794 Hz to 1000 Hz; from 1000 Hz to 1260 Hz; from 1260 Hz to 1587 Hz; from 1588 Hz to 2000 Hz; from 2000 Hz to 2520 Hz; from 2520 Hz to 3175 Hz; from 3175 Hz to 4000 Hz; from 4000 Hz to 5040 Hz; and, from 5040 Hz to 6350 Hz.

According to various embodiments, parametrically formulated noise signal generator 410 can be adaptively reconfigured in response to signal information 430 including, but are not limited to: response to minimum signal energy measurements, response to maximum signal energy measurements, response to average signal energy measurements, response to transient signal energy measurements, response to peak signal energy measurements, response to a combination of signal energy measurements representing a combination of criteria, etc.

Figure 5:
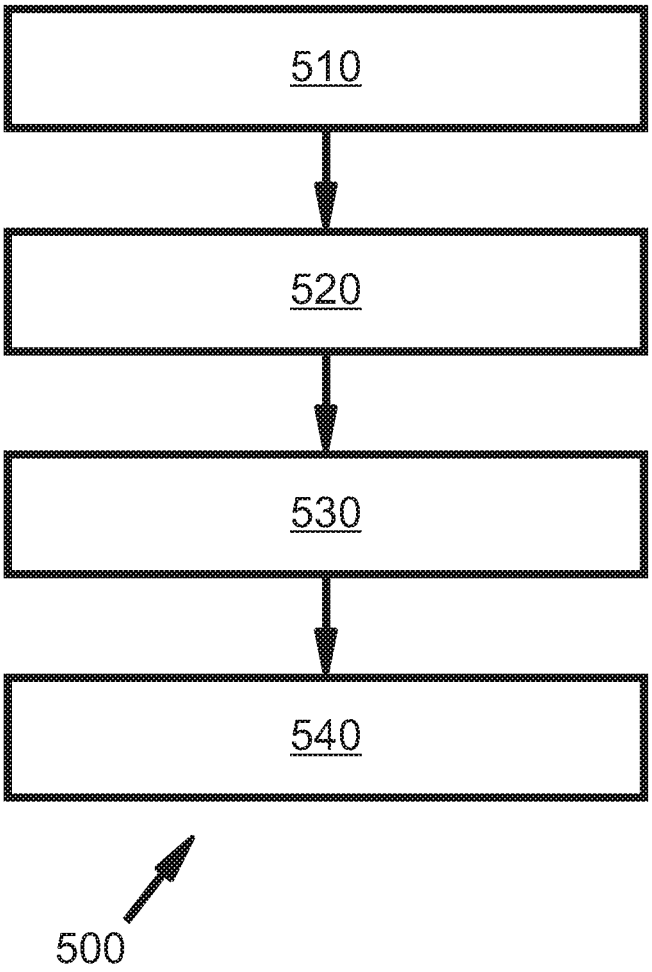
FIG. 5 illustrates a method for an audio system.

FIG. 5 illustrates a method 500 for the generation of adaptive parametrically formulated noise. In step 510, audio signal energy can be measured for a frequency band for a time interval. In step 520, a plurality of sequential audio signal energy measurements can be stored for the frequency band for immediately preceding sequential time intervals. In step 530, a minimum can be found for the plurality of sequential audio signal energy measurements for the frequency band for the immediately preceding sequential time intervals and the minimum can be provided to a parametrically formulated noise generator. In step 540, a noise sound from a parametrically formulated noise generator can be configured according to a plurality of parameters and can be adapted or modified according to the minimum found.

According to an embodiment, audio signal energy can be measured for a ⅓-octave frequency band during about a forty millisecond time interval. According to various embodiments, various methods and measurement types can be used to measure audio signal energy, including but not limited to: analog methods, digital methods, and methods associated with digital signal processing, voltage measurements, current measurements, power measurements, numerical values measurements, pulse density measurements, pulse period measurements, time integration measurements, counter measurements, etc. According to various embodiments, various different frequency bands and different time intervals can be used for the measurement of audio signal energy. According to an embodiment, audio signal energy can be measured for each of two adjacent ⅙-octave frequency bands during about a forty millisecond time interval. According to an embodiment, audio signal energy can be measured for each of three adjacent ⅓-octave frequency bands during about a forty millisecond time interval. According to an embodiment, audio signal energy can be measured for each of four adjacent 1/12-octave frequency bands during about a forty millisecond time interval. According to an embodiment, audio signal energy can be measured for each of plurality of frequency bands during about a forty millisecond time interval.

According to an embodiment, about fifty sequential audio signal energy measurements can be stored for the frequency band for the about fifty immediately preceding sequential time intervals. According to various embodiments, various types of storage devices can be used for storing the preceding measurements of audio signal energy, including but not limited to: volatile memory, non-volatile memory, flash memory, DRAM, SRAM, digital storage devices, storage devices associated with digital signal processing, hardware shift registers, memory structures, circular buffers, first-in first-out (FIFO) data buffers, etc. According to various embodiments, many different storage sizes are possible for the storage of the preceding measurements of audio signal energy. According to an embodiment, fifty sequential audio signal energy measurements can be stored for each of two adjacent ⅙-octave frequency bands for the fifty immediately preceding sequential time intervals. According to an embodiment, fifty sequential audio signal energy measurements can be stored for each of three adjacent ⅓-octave frequency bands for the fifty immediately preceding sequential time intervals. According to an embodiment, fifty sequential audio signal energy measurements can be stored for each of four adjacent 1/12-octave frequency bands for the fifty immediately preceding sequential time intervals. According to an embodiment, fifty sequential audio signal energy measurements can be stored for the multiplicity of frequency bands for the fifty immediately preceding sequential time intervals.

According to various embodiments, audio signal energy detectors configured to find a minimum value within the preceding measurements of audio signal energy for the frequency band or bands can be accomplished by, for example, iterating through a FIFO data buffer using a minimum selection computer algorithm. According to various embodiments, various different algorithms for audio signal energy detectors to find minimum audio signal energy measurements within a plurality of audio signal energy measurements can be used, including: recursive algorithms, sorting algorithms, rolling difference algorithms and the like.

According to an embodiment, a noise sound from parametrically formulated noise generator configured according to a plurality of parameters can be adapted or modified to respond with a power spectrum output that is reduced proportionally to minimum audio signal energy measurements. According to an embodiment, a noise sound from parametrically formulated noise generator configured according to a plurality of parameters can be adapted or modified to respond with a power spectrum output that is reduced proportionally to the minimum audio signal energy measurements wherein the transition time change of the minimum audio signal energy measurements is controlled with attack and decay time constants. According to various embodiments, various methods can be used for a noise sound from parametrically formulated noise generator configured according to a plurality of parameters to be adapted or modified in response to minimum audio signal energy measurements with a changing power spectrum output.

According to an embodiment, an audio system may use a plurality of instances of method 500.

According to various embodiments, in step 530 and in step 540, an adaptive response can be configured to find and respond to: minimum audio signal energy measurements, maximum audio signal energy measurements, average audio signal energy measurements, transient audio signal energy measurements, peak audio signal energy measurements, a combination of audio signal energy measurements representing a combination of criteria, etc.

Figure 6:
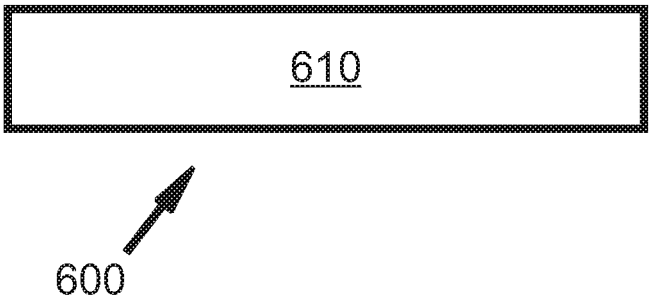
FIG. 6 illustrates a schematic diagram of an audio system.

FIG. 6 illustrates a method 600 for the generation of adaptive parametrically formulated noise. In step 610, a parametrically formulated noise sound from a parametrically formulated noise generator is generated according to a plurality of parameters and is adapted according to an audio signal.

According to an embodiment, an audio system can use a multiplicity of instances of method 600.

Figure 7:
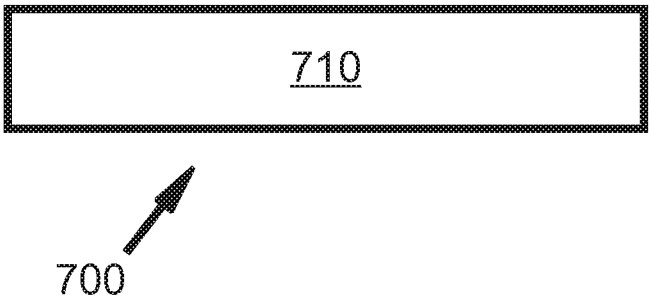
FIG. 7 a schematic diagram of a system enabling adaptive parametrically formulated noise.

FIG. 7 illustrates a method 700 for the generation of adaptive parametrically formulated noise. In step 710, a noise signal from a parametrically formulated noise generator can be generated according to a plurality of parameters and can be adapted or modified according to a signal.

According to an embodiment, a system may use a plurality of instances of method 700.

In reference to all of the foregoing disclosure, the above described embodiments enable solutions, improvements, and benefits to many problems and issues affecting conventional audio systems and conventional audio devices and offer improved functionality for audio systems and audio devices.

As disclosed herein, according to various embodiments, a power spectrum of an acoustic environment is determined for sequential durations of time and a power spectrum of parametrically formulated noise may be adaptively changed or re-engineered to compensate for problematic noise uncharacteristic of speech detected in the power spectrum of the acoustic environment in order to improve speech intelligibility in noisy acoustic environments and/or to compensate for loudness growth of acoustic environments.

According to various embodiments, the power spectrum of the parametrically formulated noise can be altered to continue to allow any additional energy from a speech phoneme to "activate" and trigger a sensorineural hearing response.

According to various embodiments, adaptive parametrically formulated noise can allow for immediate changes which are both indiscernible and inaudible.

According to various embodiments, adaptive parametrically formulated noise can actually increase the perceived signal-to-noise ratio rather than diminishing it.

According to various embodiments, parametrically formulated noise contoured to an individual's specific frequency dependent thresholds of hearing can enable hearing aid devices using sound-amplification with little or no dynamic range compression. Adding contoured parametrically formulated noise to a speech signal can "lift" the resulting sound signal to levels above the threshold of hearing. The power spectrum of the contoured parametrically formulated noise can be substantially invariant during even brief phoneme intervals allowing any additional energy from any speech phoneme to "activate" and trigger a sensorineural hearing response. Because the dynamic range of speech for frequencies above 1500 Hz (Hertz) is typically less than 20 dB (decibels), little or no compression is required for contoured parametrically formulated noise hearing aids for individuals with conductive loss and/or sensorineural hearing loss up to 65 dB HL. Such embodiments can create a safe and comfortable listening level at or below 85 dB HL (decibels Hearing Level) for these frequencies.

Benefits, other advantages, and solutions to problems and issues have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

In view of all of the above, it is evident that novel audio systems, audio devices, noise signals, noise generators, and methods are disclosed. Included, among other embodiments, is an audio system which adaptively adjusts a parametrically formulated noise signal according to environmental noise detected by the audio system. Such adaptive adjustments allow for the presentation of a substantially constant and sufficient activation energy to an individual's auditory system such that additional sound energy corresponding to speech is audible and intelligible to the individual.

While the subject matter of the invention is described with specific and example embodiments, the foregoing drawings and descriptions thereof depict only typical embodiments of the subject matter, and are not therefore to be considered limiting of its scope. It is evident that many alternatives and variations will be apparent to those skilled in the art and that those alternatives and variations are intended to be included within the scope of the present invention. For example, some embodiments described herein include some elements or features but not other elements or features included in other embodiments, thus, combinations of features or elements of different embodiments are meant to be within the scope of the invention and are meant to form different embodiments as would be understood by those skilled in the art. Furthermore, any of the above-described elements, components, blocks, instrumentalities, systems, structures, devices, filters, noise generation methods, ranges and selection of ranges, applications, programming, signal processing, signal analysis, signal filtering, implementations, proportions, flows, or arrangements, used in the practice of the present invention, including those not specifically recited, may be varied or otherwise particularly adapted to specific environments, users, groups of users, populations, manufacturing specifications, design parameters, or other operating requirements without departing from the scope of the present invention. Additionally, the steps recited in any method or processing scheme described above or in the claims may be executed in any order and are not limited to the specific order presented in the above description or in the claims. Finally, the components and/or elements recited in any apparatus claims may be assembled or otherwise operationally configured in a variety of permutations and are accordingly not limited to the specific configuration recited in the claims.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of the invention.

What is claimed is:

1. An audio system, comprising:

an input configured to receive an input audio signal comprising a speech signal; and an adaptive parametrically formulated noise generator, wherein the adaptive parametrically formulated noise generator is configured to generate a parametrically formulated noise signal having a power spectrum across a first range of frequencies corresponding to a threshold of hearing of a user of the audio system across the first range of frequencies, wherein the parametrically formulated noise signal is configured to be added to the speech signal to generate a resulting sound signal having at least a portion of the resulting sound signal within the first range of frequencies lifted above the threshold of hearing of the user of the audio system, and wherein the power spectrum of the parametrically formulated noise signal within the first range of frequencies is increased or reduced by the audio system in proportion to a measurement of the input signal within the first range of frequencies.

2. The audio system of claim 1, wherein the adaptive parametrically formulated noise generator is configured receive the input audio signal, generate a plurality of measurements corresponding to the energy levels of the input audio signal over a plurality of time intervals, store the plurality of measurements, determine a first selected measurement of the plurality of measurements based on a first criteria, and adjust the energy level of the parametrically formulated noise signal according to the value of the first selected measurement.

3. The audio system of claim 2, wherein the plurality of measurements corresponding to energy levels of the input audio signal over a plurality of time intervals are generated to correspond to a plurality of energy levels of the input audio signal within the first range of frequencies over the plurality of time intervals.

4. The audio system of claim 1, wherein the parametrically formulated noise signal is generated within the first range of frequencies.

5. The audio system of claim 4, further comprising a second adaptive parametrically formulated noise generator configured to generate a second parametrically formulated noise signal within a second range of frequencies.

6. A method for generating a parametrically formulated noise signal, comprising:

receiving an input signal;

recursively measuring the energy level of the input signal over a period of time;

generating a plurality of measurements corresponding the energy levels of the input signal measured over a period of time;

storing the plurality of measurements;

determining a selected measurement of the plurality of measurements based on a criteria;

generating a parametrically formulated noise signal having a power spectrum across a first range of frequencies corresponding to a threshold of hearing of a user of the audio system across the first range of frequencies;

adjusting the energy level of the parametrically formulated noise signal according to the value of the selected measurement;

adding the parametrically formulated noise signal to a speech signal withing the input signal; and, generating a resulting sound signal having at least a portion of the resulting sound signal within the first range of frequencies lifted above a threshold of hearing of a use of an audio system.

7. The method of claim 6, wherein adjusting the energy level of the parametrically formulated noise signal according to the value of the selected measurement occurs continuously as the value of the selected measurement changes over time.

8. An audio system, comprising:

an audio signal meter configured to measure the energy level of an audio signal within a first band of frequencies and generate a plurality of measurements of the energy level of the audio signal over a period of time;

a storage device configured to store the plurality of measurements of energy of the audio signal over the period of time;

an audio signal energy detector configured to detect a criteria measurement value from the plurality of measurements according to a first criteria; and, a parametrically formulated noise generator configured to generate a parametrically formulated noise signal having a power spectrum across a first range of frequencies corresponding to a threshold of hearing of a user of the audio system across the first range of frequencies, wherein the parametrically formulated noise generator is also configured to receive the criteria measurement value and adaptively reconfigure the parametrically formulated noise signal in response to the criteria measurement value, wherein the audio system is configured to add the parametrically formulated noise signal to the audio signal and generate a resulting sound signal having at least a portion of the resulting sound signal within the first range of frequencies lifted above a threshold of hearing of a user of the audio system.

9. The audio system of claim 8, wherein the first criteria comprises detecting the presence of voice activity.

10. The audio system of claim 9, wherein adaptively reconfiguring the parametrically formulated noise signal includes maintaining or increasing the volume of the parametrically formulated noise signal when the criteria measurement value has a value which indicates the presence of voice activity.

11. The audio system of claim 10, wherein maintaining or increasing the volume of the parametrically formulated noise signal comprises maintaining or increasing the volume of parametrically formulated noise signal for a frequency range where a user of the audio system has hearing ability.

12. The audio system of claim 10, wherein maintaining or increasing the volume of the parametrically formulated noise signal comprises maintaining or increasing the volume of parametrically formulated noise signal for a frequency range where speech sounds are present.

13. The audio system of claim 9, wherein adaptively reconfiguring the parametrically formulated noise signal includes maintaining or decreasing the volume of the parametrically formulated noise signal when the criteria measurement value has a value indicates the absence of voice activity.

14. The audio system of claim 8, wherein the first criteria comprises detecting the presence of speech sounds.

15. The audio system of claim 8, wherein the first criteria comprises detecting a minimum value from the plurality of measurements.

16. The audio system of claim 8, wherein the first criteria comprises detecting a maximum value from the plurality of measurements.

17. The audio system of claim 8, wherein the first criteria comprises detecting a median value from the plurality of measurements.

18. The audio system of claim 8, wherein the first criteria comprises detecting a transient value from the plurality of measurements.

19. The audio system of claim 8, further comprising:

a second audio signal meter configured to measure the energy level of an audio signal within a second band of frequencies and generate a second plurality of measurements of the energy level of the audio signal over a period of time; and wherein the storage device configured to store the second plurality of measurements of energy of the audio signal over the period of time; and wherein the audio signal energy detector is further configured to detect a second criteria measurement value from the second plurality of measurements according to a second criteria; and wherein the parametrically formulated noise generator is further configured to receive the second criteria measurement value and adaptively reconfigure the parametrically formulated noise signal in response to both the criteria measurement value and the second criteria measurement value.

* * * * *